United States Patent [19]

Laurent et al.

[11] Patent Number: 4,991,194

[45] Date of Patent: Feb. 5, 1991

[54] ROTATING ANODE FOR X-RAY TUBE

[75] Inventors: Michel Laurent, Plaisir; Pierre Noualhaguet, Issy Les Moulineaux; Claude Mathieu, Versailles, all of France

[73] Assignee: General Electric CGR S.A., Paris, France

[21] Appl. No.: 291,765

[22] Filed: Dec. 29, 1988

[30] Foreign Application Priority Data

Dec. 30, 1987 [FR] France ..... 87 18367

[51] Int. Cl.[5] ..... H01J 35/08; H01J 35/10

[52] U.S. Cl. ..... 378/144; 378/124; 378/143; 378/125; 378/127

[58] Field of Search ..... 378/121, 125, 127, 128, 378/135, 137, 124, 143, 144

[56] References Cited

U.S. PATENT DOCUMENTS

| | | | |
|---|---|---|---|
| 3,473,156 | 8/1976 | Schreiber | 378/125 |
| 3,836,803 | 9/1974 | Dietz et al. | 378/125 |
| 3,836,804 | 9/1974 | Frens et al. | 378/125 |
| 4,358,856 | 11/1982 | Stivender et al. | 378/167 |
| 4,461,020 | 7/1984 | Hübner et al. | 378/125 |
| 4,531,227 | 7/1985 | Fukuhara et al. | 378/125 |

FOREIGN PATENT DOCUMENTS

| | | |
|---|---|---|
| 0165157 | 12/1985 | European Pat. Off. . |
| 2120344 | 12/1971 | Fed. Rep. of Germany . |
| 2130259 | 11/1972 | France . |
| 2160533 | 6/1973 | France . |
| 2500958 | 9/1982 | France . |
| 2588745 | 4/1987 | France . |
| 2098440 | 11/1982 | United Kingdom . |

*Primary Examiner*—Edward P. Westin
*Assistant Examiner*—Don Wong
*Attorney, Agent, or Firm*—Oblon, Spivak, McClelland, Maier & Neustadt

[57] ABSTRACT

The invention relates to a rotating anode for an X-ray tube, which avoids the anarchical generation of cracks in a target carried by the anode. For this purpose, at least a part of a target area is carved by a plurality of radial slots arranged symmetrically with respect to an axis of symmetry of the anode. The depth of the slots is less than the thickness of the target.

6 Claims, 1 Drawing Sheet

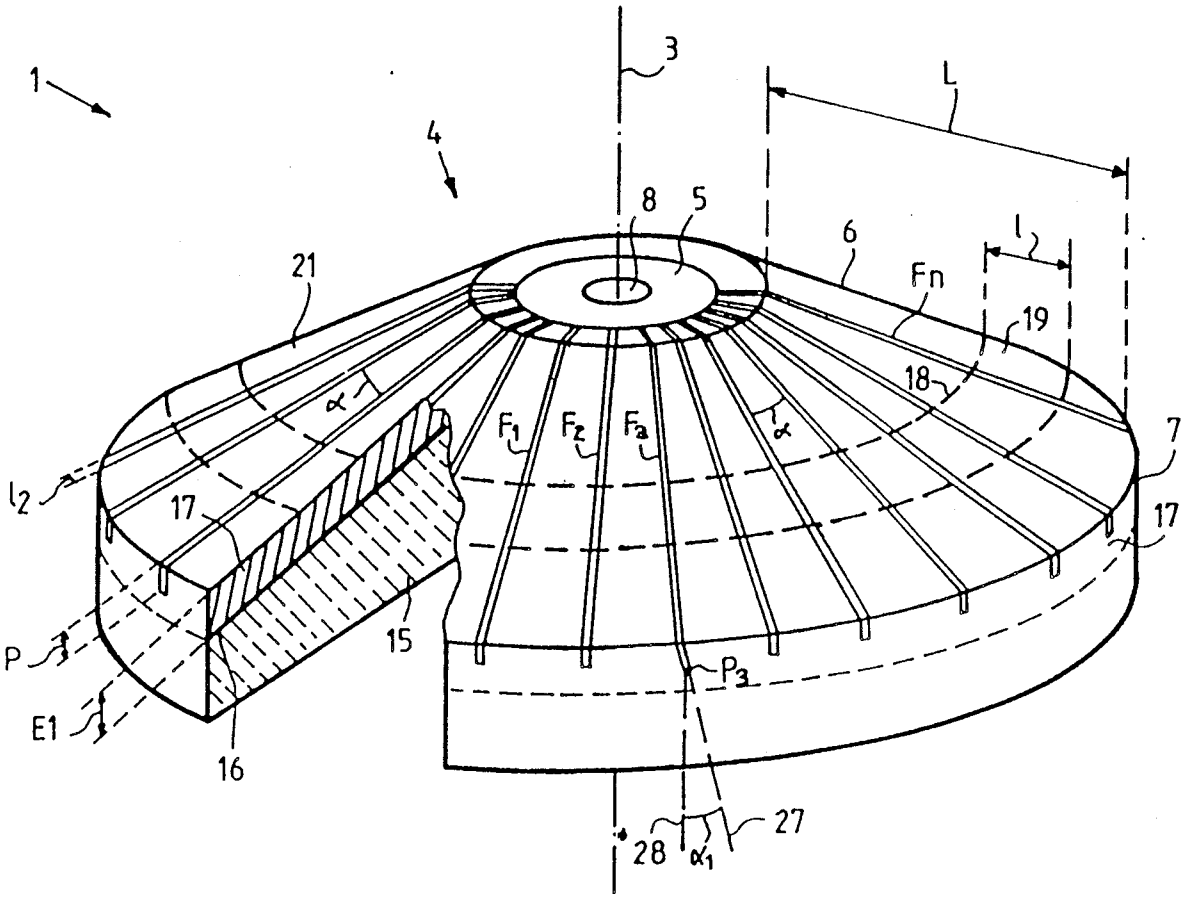
1
2
3
4
5
6
7
8
15
16
17
17
18
19
21
27
28
E1
P
P3
L
l
Fn
F1
F2
F3
α
α
α1

ROTATING ANODE FOR X-RAY TUBE

BACKGROUND OF THE INVENTION

The present invention relates to a rotating anode for an X-ray tube and, more particularly, to means for avoiding the anarchical creation of cracks in a target supported by the anode.

With X-ray tubes, X-radiation is currently obtained by electronic bombardment of an anode. More specifically, electronic bombardment is focused onto a small area referred to as the focal point of a target enclosed in the anode, which focal point becomes the source of X-radiation.

A small part of the electrical energy which is used to accelerate the electrons (approximately 1%) is transformed into X-rays. The remainder of this energy is dissipated into heat. This heat, mainly evacuated by radiation, can lead to the deterioration of the anode and, more particularly, to the deterioration of the target, such as the melting of the focal point of the target.

Consequently, the target is generally made of a material which not only has a high atomic number to promote the generation of X-rays, but also a refractory material which is a good conductor of heat, e.g. tungsten or molybdenum or alloys thereof, etc.

However, whatever the material of that the target is made of, the instantaneous power levels involved (in the order of 100 kW) create major stresses in the surface layers of such a material.

To decrease the temperature at the focal point, a current solution consists in having the target run under the focal point or the impact of the electron beam. This movement of the target is obtained by a rotation of the anode about an axis of symmetry of the latter, with the anodes being generally in the form of a disk. The movement of the target beneath the focal point created on impact of the electron beam generates, on the target and around the axis of symmetry, a focal crown or ring of several millimeters in width.

A fast rotation of the anode, (several thousands of revolutions per minute) is required to distribute the thermal flow around the focal crown. But the temperature of the focal point remains far higher than the temperature of the remainder of the focal crown, which itself has a temperature well above that of the remainder of the anode disk.

It is observed that at each point of this focal crown a "thermal pulse" is received on each revolution of the anode. With the materials generally used for the emission of X-radiation under the effect of electronic bombardment, i.e. target materials such as tungsten typically, fluctuations due to such pulses may be considered as insignificant beyond a surface layer, the thickness thereof being in the order of 100 microns. Accordingly, it is essentially this surface layer which is subjected to a series of thermal shocks due to the rotation and, consequently, to major mechanical stresses.

Further, at another time scale, there may be a pause which may last for example 0.1 second to 1 second or even more, while the entire focal crown receives considerable thermal flow that only diffuses gradually throughout the entire anode disk.

Consequently, the inventors have thought that the focal crown is subjected to a major compression due to a major expansion of the target material and that, the target material is likely to come out of the elasticity range of the material so that a tensile stress resulting from cooling may generate cracks in the surface of the material of which the target is made.

These cracks tend to increase in number and scale with the operating time, and become detrimental to the correct operation of the X-ray tube: thus for example, in the case of an anode made of a basic body (typically of graphite), coated with a layer of X-ray emitting material or target material (e.g. tungsten), such cracks may extend to the graphite and lead to the lifting-off of the layer of tungsten resulting in the fast destruction of the tube; it is also be noted that such cracks if too numerous, tend to reduce the amount of X-rays emitted by the focal point.

SUMMARY OF THE INVENTION

The present invention relates to a rotating anode for an X-ray tube, arranged in a new manner which permits avoiding the random and uncontrolled formation of cracks within the target.

According to the present invention, a rotating anode of an X-ray tube comprising a target which is to be subjected to electronic bombardment in order to generate X-radiation is characterized in that the surface of the target is carved by a plurality of equidistant slots, arranged symmetrically with respect to an axis of symmetry of the anode.

The invention shall be better understood referring to the following description, given as a non-limitative example, and the single appended FIGURE which shows schematically in a perspective view, a rotating anode according with the invention.

DESCRIPTION OF THE PREFERRED EMBODIMENT

The single FIGURE shows a rotating anode 1 for an X-ray tube (not shown). In the non-limitative example of the description, the anode 1 is formed as a disk having an axis of symmetry 3 and a shape which is approximately truncated; i.e., one face 4 is formed from a central part 5 which is a plane surrounded by a sloping part 6 which joins the circular surrounding edges 7 of the anode disk 1.

In the non-limitative example described, the central part 5 includes a hole 8, arranged according to the axis of symmetry 3, and intended to provide for the passage of a supporting shaft (not shown) used to carry the rotating anode 1.

In the non-limitative example of the description, as shown in the cut-away view of the FIGURE, rotating anode 1 is of a type comprising a basic body 15 or substrate, typically of graphite, on which an intermediate attaching layer 16, typically of rhenium, is deposited; a layer of the target material 17 typically of tungsten, is deposited on the intermediate attaching layer 16.

The layer 17 of the target material has been formed into one or several layers deposited according to a known process, such as electrolythic deposition for example, or chemical vapour deposition (CVD) or, alternatively, by the process of deposition by projection by a plasma torch etc.

In the non-limitative example described, the layer of target material 17 or target has a thickness E1 comprised between 100 microns and 700 microns.

It is understood that in the spirit of the invention, the thickness E1 of target 17 may be different and that target 17 may be made up according to a solid structure directly, formed for example, by the basic body 15 itself made of the target material; or alternatively target 17 may be fixed to the base body 15. The layer 17 of target material forms a target intended to be bombarded by an electron beam (not shown) so as to generate X-radiation.

Indeed, target 17 is intended to be subjected to electronic bombardment over a small area wherein focal point 18 is constituded, from which the rotating anode 1 rotation about the axis of symmetry 3 generates a focal crown or ring 19 (shown in dotted lines). In the non-limitative example described herein, layer 17 of the target material is deposited on the overall sloping section 6 but this layer 17 may be deposited on a smaller area, so as to constitute the target according to a crown corresponding more or less to the focal crown or ring 19.

According to a feature of the present invention, and in order to avoid anarchical cracking of target 17 under the effect of electronic bombardment, the area 21 of target 17 is carved by a plurality of slots F1, F2, F3 . . . Fn which are equidistant and arranged symmetrically with respect to the axis of symmetry 3.

In the non-limitative example shown in the FIGURE where target 17 is formed on a face 4 of anode 1, that length L of slots F1 to Fn will extend radially and correspond to the generating lines of the cone.

But the usefulness of slots F1 to Fn appears more particularly with respect to the bombarded areas i.e. the focal crown 19, and the length L of slots F1 to Fn can be limited and correspond more or less to a width 1 of focal crown 19.

The slots F1 to Fn have a depth P less than thickness E1 of target 17 so as to permit to subsist a sufficient quantity of target material between a bottom 23 of slots F1 to Fn and the substrate or basic body 15.

Indeed, the depth P of slots F1 to Fn shall be equal to or greater than the thickness of the surface layer, estimated at approximately 100 microns, as referred to in the preamble as the layer beyond which thermal fluctuations are insignificant.

In practice, a satisfactory compromise can be obtained by endowing to thickness P a value included between $\frac{1}{3}$ and $\frac{2}{3}$ of thickness E1 of the layer of target material 17; i.e. for a thickness E1 of 300 microns, depth P may be comprised between 100 microns and 200 microns.

In the non-limitative example described herein, slots F1 to Fn are radial, so that they permit mechanical stress relaxation without inhibiting thermal exchanges.

The spacing of slots F1 to Fn is a compromise between a concern to slightly decrease the efficiency of radiation X of target 17 (efficiency is decreased if slots F1 to Fn are too tight), and a concern to provide slots F1 to Fn with optimum efficiency.

We have observed that our angular deviation $\alpha$ comprised between approximately 5° and 10° was a good compromise, but it is obvious that these limits are not confining.

It should be noted that the width 12 of slots F1 to Fn must be as small as possible, taking account of the technological design considerations. These technological considerations may also lead to increasing the length L of slots F1 to Fn beyond the length strictly necessary.

To obtain slots F1 to Fn, several processes, known per se, may be used such as, for instance: through mechanical cutting, melting with a laser beam or alternatively electro-erosion ; it will appear that the latter process is particularly suitable for the production of very fine slots F1 to Fn (length $l_2$ in the range of a few 1/100 millimeter) with any geometry.

It is even possible to consider slots F1 to Fn whose depth P extends in a non-rectilinear manner to prevent electrons (not shown) impinging at an oblique angle from reaching the bottom 23 of the slots.

To avoid the direct impact of electrons on the bottom 23 of slots F1 to Fn, the slot plane may be inclined from the normal plane at surface 21 of the target. An example of the inclination of a slot is given with respect to a third slot F3 by an axis 27 parallel to depth P3 of the third slot forming an angle of inclination $\alpha_1$, with a second axis 28 symbolizing a plane at right angles to the surface 21. The angle of inclination $\alpha_1$ is to be determined according to the width 12 and depth P of a 5 slot F1 to Fn. For the purpose of illustration, angle $\alpha_1$ may have a value of 15° for depth P of 150 microns and width $l_2$ of slot F3 of approximately 50 microns.

It should be noted that the angle $\alpha_1$ shall remain relatively small in order not to inhibit thermal exchanges which are essentially made according to directions parallel to the axis of symmetry 3 and to the radial directions (because all the points of the focal crown 19 are at a neighboring temperature).

It should be observed that the mechanical stresses, on the contrary, whether due to compression or traction, are mainly tangential thus explaining that the cracks, when they occur, are generally radial.

The construction of slots F1 to Fn in the area 21 of target 17 is a simple solution which is easy to implement regarding the problem of anode aging represented by target cracking. In the non-limitative example described and shown in the FIGURE, length L of slots F1 to Fn extend in radial directions. But, in the spirit of the invention, the orientation of the length of such slots may differ in particular if the target is formed on the edge or periphery of the rotating anode disk: in such a case, the slot length will be parallel to the axis of symmetry or the axis of rotation of the anode; such a target arrangement is usual in the case of rotating anodes for mammography.

What is claimed is:

1. A rotating anode for an x-ray tube having an axis of symmetry, comprising:

a substrate;

a target in the form of a layer of emissive material formed on said substrate, said target having a predetermined thickness;

a plurality of radial slots carved into said target, said radial slots being equidistant and arranged symmetrically with respect to said axis of symmetry;

said radial slots being carved to a predetermined depth, wherein said predetermined depth is between $\frac{1}{3}$ to $\frac{2}{3}$ of the thickness of the target.

2. An anode according to claim 1, wherein the depth of said slots is between 100 and 200 microns.

3. An anode according to claim 1, wherein the depth of said slots is not uniform.

4. An anode according to claim 1, wherein the depth of said slots is inclined with respect to a plane at right angles to the area of the target.

5. Anode according to claim 1, wherein said slots extend radially over at least a width of a focal crown.

6. Anode according to claim 1, wherein said slots have between one another an angular spacing $\alpha$ comprised between 5° and 10°.

* * * * *